United States Patent [19]

Fukui et al.

[11] 4,174,213

[45] Nov. 13, 1979

[54] HIGHLY DUCTILE ALLOYS OF IRON-NICKEL-CHROMIUM-MOLYBDENUM SYSTEM FOR GAS TURBINE COMBUSTOR LINER AND FILLER METALS

[75] Inventors: Yutaka Fukui; Fumio Hataya; Tetsuo Kashimura, all of Hitachi, Japan

[73] Assignee: Hitachi, Ltd., Japan

[21] Appl. No.: 882,455

[22] Filed: Mar. 1, 1978

[30] Foreign Application Priority Data

Mar. 4, 1977 [JP] Japan ..... 52-22666

[51] Int. Cl.[2] ..... C22C 19/00; C22C 28/00

[52] U.S. Cl. ..... 75/134 F; 75/128 G; 75/128 R; 75/128 W; 75/134 N; 75/171

[58] Field of Search ..... 75/134 F, 128 R, 128 T, 75/128 W, 128 G, 134 N, 171, 122; 60/200 A

[56] References Cited

U.S. PATENT DOCUMENTS

| | | | |
|---|---|---|---|
| 2,763,921 | 9/1956 | Turner, Jr. et al. | 29/198 |
| 2,955,934 | 10/1960 | Emery | 75/134 |
| 3,169,367 | 2/1965 | Hussey | 60/39.37 |
| 3,366,473 | 1/1968 | Nehrenberg et al. | 75/128 |
| 3,420,660 | 1/1969 | Kawahata et al. | 75/122 |
| 3,493,366 | 2/1970 | Hopkins | 75/122 |
| 3,681,059 | 8/1972 | Shaw et al. | 75/134 F |
| 3,758,295 | 9/1973 | Morley et al. | 75/122 |
| 3,778,256 | 12/1973 | Sasaki et al. | 75/134 F |
| 3,837,846 | 9/1974 | Becker et al. | 75/124 |
| 3,844,774 | 10/1974 | Culling | 75/134 F |
| 3,865,581 | 2/1975 | Sekino et al. | 75/122 |
| 3,930,904 | 1/1976 | Eiselstein et al. | 148/38 |
| 4,006,012 | 1/1977 | Kindlimann | 75/122 |
| 4,042,383 | 8/1977 | Petersen et al. | 75/171 |
| 4,063,934 | 12/1977 | Thuillier et al. | 75/122 |
| 4,078,951 | 3/1978 | Denzine et al. | 148/32.5 |
| 4,080,201 | 3/1978 | Hodge et al. | 75/171 |

FOREIGN PATENT DOCUMENTS

| | | | |
|---|---|---|---|
| 1264006 | 2/1972 | United Kingdom | 75/134 F |

*Primary Examiner*—L. Dewayne Rutledge
*Assistant Examiner*—Upendra Roy
*Attorney, Agent, or Firm*—Craig and Antonelli

[57] ABSTRACT

The present alloys of iron-nickel-chromium-molybdenum system are alloys having high strength and ductility, comprising 0.03–0.2% by weight of carbon, not more than 2% by weight of silicon, not more than 2% by weight of manganese, 42–70% by weight of nickel, 15–35% by weight of chromium, 4.5–15% by weight of molybdenum, 0.05–1.0% by weight of at least one of Ti and Nb as additive elements, and 7.5–35% by weight of iron, the balance being incidental impurities, or further contain 0.1–10% by weight of at least one of tungsten and cobalt as reinforcing elements.

34 Claims, 7 Drawing Figures

HIGHLY DUCTILE ALLOYS OF IRON-NICKEL-CHROMIUM-MOLYBDENUM SYSTEM FOR GAS TURBINE COMBUSTOR LINER AND FILLER METALS

LIST OF PRIOR ART REFERENCES (37 CFR 1.56 (a))

The following references are cited to show the state of the art:

U.S. Pat. No. 2,955,934
U.S. Pat. No. 3,366,473
U.S. Pat. No. 3,420,660
U.S. Pat. No. 3,681,059
U.S. Pat. No. 3,778,256

This invention relates to novel alloys of iron-nickel-chromium-molybdenum system having high strength and ductility, which are particularly suitable as high temperature resistant materials applicable to such a high temperature that carbides precipitate in the alloys, materials applicable to exposure to combustion gas, materials for plastic working, filler metal, and combustor liner and transition piece materials for gas turbine.

Heat resistant alloys for forging, comprising about 45% by weight of nickel, about 25% by weight of chromium, 0.1–0.5% by weight of titanium, and 0.2–0.9% by weight of niobium, the balance being iron, applicable, for example, to a gas turbine combustor at 700° to 1000° C. are known (U.S. Pat. No. 3,778,256), but the alloys have a low strength owing to the absence of a solid solution-intensifying element and an intensifying element due to precipitation of carbides.

Recently, fabrication of gas turbine combustors of larger scales is in demand, and consequently materials having higher strength at elevated temperatures are required for the combustors. To meet the requirements, heat-resistant alloys of iron-nickel-chromium austenite system containing a large amount of tungsten, cobalt, molybdenum, niobium, etc. as an additive, directed to solid solution intensification and intensification due to partial precipitation of carbides have been proposed (U.S. Pat. Nos. 2,955,934; 3,366,473; 3,420,660 and 3,681,059). However, these alloys can have a considerably improved creep rupture strength owing to the inclusion of a large amount of the intensifying elements, but have such disadvantages as low elongation and reduction of area after the creep rupture, owing to formation of a large amount of carbides and intermetallic compounds other than the carbides. Especially, alloys having a high strength at elevated temperatures and simultaneously having no lowering inductility at elevated temperatures even after a long period of service are required for the materials susceptible to a thermal stress by quick heating and quenching at starting and stopping or a thermal stress due to temperature differences during the period of service, such as combustor liners and transition piece for gas turbine.

Strength at elevated temperatures is represented by creep rupture strength, and ductility at elevated temperatures after heating for a long period of time is judged by percent elongation and percent reduction of area after the creep rupture.

Precipitation in excess of carbides of chromium, tungsten, molybdenum, etc. not only lowers the ductility, but also gives an adverse effect upon a resistance to corrosion at elevated temperatures or repairing by welding of cracks formed during the period of service.

No suitable filler metal has been found yet for the repairing by welding.

As described above, the prior art heat-resistant alloys having high nickel and chromium contents containing molybdenum, tungsten, cobalt, etc. can have an improved creep rupture strength, but have a low ductility, particularly a poor ductility after heating at elevated temperatures for a long period of time and at creep rupture, and thus cracks due to thermal fatigue are developed when such alloys are used as materials to undergo repetitions of thermal stress for a long period of time, such as in gas turbine combustor. Especially, the gas turbine combustor liner has sickle blade-shaped openings (louver holes) serving for both compressed air intake and cooling. The louver holes have sharply cuts at both ends, and thus cracks due to thermal fatigue are very liable to develop at these end parts.

On the other hand, the heat-resistant alloys contain a large amount of chromium, and thus chromium carbide precipitates in excess when the alloys are used at elevated temperatures for a long period of time. That is, the chromium content of matrix is lowered, and thus their resistances to oxidation and corrosion at elevated temperatures are considerably lowered after a long period of service. These will be a cause of serious corrosion by sulfur compounds in combustion gas, and consequently a further cause of shorter life, when the alloys are used as materials applicable to exposure of combustion gas, such as in the gas turbine combustor.

Primary object of the present invention is to provide novel alloys of iron-nickel-chromium-molybdenum system having high strength and ductility.

Another object of the present invention is to provide novel alloys of iron-nickel-chromium-molybdenum system having high strength and ductility at elevated temperatures, particularly those having high ductility even after used in a temperature range, where carbides procipitate, for a long period of time.

Other object of the present invention is to provide novel alloys of iron-nickel-chromium-molybdenum system having a good resistance to corrosion in combustion gas.

Still other object of the present invention is to provide alloys having high strength and ductility at elevated temperatures and high resistances to corrosion and thermal fatigue for gas turbine combustor liner and transition piece.

Further object of the present invention is to provide a filler metal having a good weldability.

The present alloys comprise 0.03–0.2% by weight of carbon, not more than 2% by weight of silicon, not more than 2% by weight of manganese, 42–70% by weight of nickel, 15–35% by weight of chromium, 4.5–15% by weight of molybdenum, 0.05–1.0% by weight of at least one of titanium and niobium, and 7.5–35% by weight of iron, the balance being incidental impurities, and have good strength and ductility, and further a high ductility at elevated temperatures after heating at elevated temperatures for a long period of time.

That is, the present alloys of iron-chromium-nickel system containing 4.5–15% by weight of molybdenum and further containing at least one of titanium and niobium have considerably higher creep rupture strength and percent elongation after creep rupture, and higher strength and ductility at elevated temperatures than the alloys of iron-chromium-nickel system containing less than 4.5% by weight of molybdenum and further containing at least one of titanium and niobium. Such effects of the present invention can be obtained particularly when 4.5–15% by weight of molybdenum, and at least one of titanium and niobium are added to alloys comprising 42–70% by weight of nickel, 15–35% by weight of chromium, and 7.5–35% by weight of iron.

In the present invention, it seems that the high strength and ductility at elevated temperatures can be obtained by adding molybdenum and at least one of titanium and molybdenum in combination to the alloys of iron-nickel-chromium system, and their combined addition can contribute to improvements of crystal boundary state as well as intracrystalline state.

Among the additives of titanium and niobium, the present alloys containing titanium alone have high ductility and resistance to corrosion, the present alloys containing niobium alone have a high ductility, and a high strength at elevated temperatures, and the present alloys containing a total of 0.05–1.0% by weight of titanium and niobium together particularly have a high ductility, a high strength at elevated temperatures, and a high ductility after heating at elevated temperatures for a long period of time.

Preferably composition of the present alloys is 0.05–0.15% by carbon, 0.5–1.5% by weight of silicon, 0.5–2% by weight of manganese, 44–50% by weight of nickel, 22–30% by weight of chromium, 5–10% by weight of molybdenum, 0.2–0.6% by weight of at least one of titanium and niobium, and 15–25% by weight of iron. Thise alloys are excellent in strength and ductility, and also excellent in resistance to corrosion in a corrosive atmosphere at elevated temperatures. That is, a combination of the alloy of iron-nickel-chromium system with not less than 5% of molybdenum and at least one of titanium and niobium has a high ductility at elevated temperatures even after the heating for a long period of time, and a high strength at elevated temperatures, and a good resistance to corrosion.

In the alloys of the present invention, alloys containing a total of 0.2–0.6% by weight of both titanium and niobium have a particularly better ductility, and also better resistances to thermal fatigue and corrosion.

Furthermore, the present invention provides alloys comprising 0.03–0.2% by weight of carbon, not more than 2% by weight of silicon, not more than 2% by weight of manganese, 42–70% by weight of nickel, 15–35% by weight of chromium, 4.5–15% by weight of molybdenum, 0.05–1.0% by weight of at least one of titanium and niobium, and 7.5–35% by weight of iron, to which 0.1–10% by weight of at least one of tungsten and cobalt is added. The alloys have a higher strength at elevated temperatures than the alloys containing no tungsten and cobalt, and thus have a longer life as materials applicable to exposure to the elevated temperatures.

In the alloys of the present invention, the alloys containing both tungsten and cobalt have a particularly high strength at elevated temperatures, and are more suitable as materials for the high temperature service. That is, precipitation of carbides is repressed in the temperature range where the carbides precipitate in the matrix of the alloys according to the present invention, the present alloys thus have a high strength even after used for a long period of time, and are suitable as material for the high temperature service. Furthermore, the present alloys have a high resistance to corrosion in the combustion gas atmosphere, and are suitable as corrosion-resistant materials. That is, in the alloys of the present invention, precipitation of chromium carbide is repressed even in heating for a long period of time, and accordingly the chromium playing a role to resist the corrosion is not consumed in the matrix, that is, the corrosion resistance of the alloys is not lowered.

The alloys of the present invention also have a good weldability, and thus are suitable as filler metal. Its composition is almost equal to that of said alloys.

The alloys of the present invention have characteristics suitable as a plastic working materials. First of all, their good ductility enhances a shapability, and especially facilitates a processing to plate forms. For example, the alloys of the present invention are particularly suitable as combustor liner and transition piece materials for gas turbine. These materials require a good shapability as plates, a good resistance to corrosion by combustion gas, no lowering in the strength and ductility even after a long period of service at elevated temperatures, and a good resistance to fatigue, especially because the liner has louver holes and are liable to be subject to thermal fatigue by rapid heating and quenching. The alloys of the present invention have good effects upon these requirements.

Grounds for restricting the components of the alloys of the present invention are given below:

Titanium and niobium in a range of 0.005–1.0% by weight can improve the strength and ductility of the alloys. It is known that these elements, like molybdenum and tungsten, are carbide-forming elements, but so long as they are contained in a very small amount, they can retard the migration of carbon, interrupt precipitation of carbon together with chromium, tungsten and molybdenum as carbides, and have an effect upon the improvement of the ductility at elevated temperatures. That is to say, addition of a very small amount of titanium and niobium has an action to retard the precipitation of carbides. Heretofore, the heat-resisting steel has attained an object of improving the creep rupture strength by the precipitation of carbides and the resulting intensification, but the intensification by the precipitation of carbides are only effective at a low temperature such as 500°–700° C., or even at a temperature of 700°–1000° C. only for a shorter period of time, whereas the growth of carbides and their formation into coagulated larger coarse grains are promoted at elevated temperatures for a long period of service, making the alloys brittle and also lowering their strength. The carbides precipitate preferentially at grain-boundaries, and thus alloys containing much molybdenum and tungsten are immediately embrittled at the grain-boundaries when exposed to elevated temperatures, and are subject to creep rupture without any improvement of the ductility. Thus, it is an ideal to slowly precipitate the carbides while put into service with the view to the actual service time as a target, to bring about the most suitable state for carbide precipitation.

The addition of titanium and niobium can retard the precipitation of carbides and can slowly precipitate the carbides in a uniformly dispersed state in the matrix, without any continual precipitation of the carbide at the grain-boundaries as a cause for the embrittlement, and thus can increase a deformability of the grain-boundaries as well as of the matrix, thereby obtaining a larger creep rupture ductility. At the same time, the precipitation slowly takes place, and thus the higher strength can be maintained even after a long period of the service.

Titanium also has strong actions of deoxidation and denitriding, and can lower the oxygen content and nitrogen content of the alloy, thereby improving the ductility of the matrix and consequently enhancing the same carbon interstitial solid solution limit. However, said titanium and niobium effects cannot be obtained to a good satisfaction unless their content is less than 0.05% by weight, and the ductility is lowered, to the contrary, even by single or combined addition thereof, so long as their content is more than 1.0% by weight. Particularly, their single or combined addition in a range of 0.2–0.6% by weight having a better effect upon the ductility is preferable. Larger effect of the combined addition of titanium and niobium than their single addition has been already explained in the foregoing passages.

On the other hand, the retarded precipitation of carbides of chromium as the main component and others ensures that the large amount of chromium can be maintained as such in the matrix, and thus the resistances to oxidation and corrosion at elevated temperatures can be improved thereby at the same time. In repairing cracks developed during the period of service, the alloys of the present invention have a good weldability, and thus can facilitate such repairing.

Carbon is added to enhance the strength, but too much carbon is liable to promote carbide precipitation, and thus its upper limit must be 0.5% by weight, but in view of the ductility, small as a carbon content as possible is preferable. A range of 0.05–0.15% by weight is preferable as the range highly satisfying both properties of strength and ductility, and, a range of 0.08–0.12% by weight is more preferable.

Silicon is added in a range of not more than 3% by weight as a deoxidation agent, and it is necessary to add at least 0.3% by weight of silicon to expect a satisfactory action of deoxidation. To prevent lowering of the ductility and precipitation of sigma phase appearing when heated to elevated temperatures, a range of 0.5–1.5% by weight of silicon is particularly preferable.

Manganese is added in a range of not more than 3.0% by weight to effect deoxidation and desulfurization, and it is necessary to add at least 0.5% by weight of manganese to expect satisfactory deoxidation and desulfurization. A range of 0.5–2.0% by weight of manganese is preferable to prevent lowering of the resistance to oxidation, and the precipitation of sigma phase.

Addition of chromium in a range of 15–35% by weight is quite necessary for ensuring the resistance to oxidation and resistances to corrosion at elevated temperatures as well as at low temperatures by corrosive gases or materials such as $SO_2$, CO, $H_2S$, $Cl^-$, $V_2O_5$, $Na_2SO_4$ and others. It is particularly necessary to add at least 22% by weight of chromium to ensure satisfactory resistances to oxidation and corrosition at 700° C. or higher temperatures. Furthermore, it is desirable to add not more than 35% by weight of chromium to prevent lowering of the ductility and hot workability. A range of 22–30% by weight of chromium is preferable to add to prevent the precipitation of sigma phase appearing when used at elevated temperatures and ensure the resistance to corrosion at elevated temperatures. Among others, 24–27% by weight of chromium is more preferable in view of the service at more elevated temperatures.

Addition of 42–70% by weight of nickel can stabilize an austenite structure and effectively provide good strength, ductility, resistance to corrosion at elevated temperatures and plastic workability to the alloys. Particularly at elevated temperatures, nickel has actions to prevent the precipitation of sigma phase, eliminate an occurrence of embrittlement when heated for a long period of time, and enhance the strength and ductility of the alloys at elevated temperatures, resistance to oxidation, and resistance to corrosion at elevated temperatures. When less than 42% by weight of nickel is added, the resistance to corrosion at elevated temperature of the alloys is lowered, and also their strength, ductility and workability are lowered. At the nickel content above 70% by weight, the resistance to corrosion at elevated temperatures and hot workability are lowered, and the effect upon the ductility at elevated temperatures becomes less. Particularly, a range of 44–50% by weight of nickel is effective upon the resistance to corrosion, ductility and strength at elevated temperature. That is, the alloys having a nickel content of 44–50% by weight have a good resistance to corrosion at elevated temperatures by combustion gas, and thus are materials suitable for application in such atmosphere.

Molybdenum is added in a range of 4.5–15% by weight, as an important element of enhancing the strength and ductility of the alloys through combination with titanium and niobium, and thus its addition in a range of at least 4.5% by weight can considerably improve particularly the creep rupture strength and elongation, but the addition in the range above 15% by weight lowers the workability, and particularly lowers the resistance to oxidation at elevated temperatures. To eliminate the fear of precipitation of sigma phase or excess carbides, and the resulting enbrittlement, a range of 5–10% by weight of molybdenum is particularly preferable.

0.1–10% by weight of tungsten is added to effect intensification by carbide formation or intensify solid solution. Its addition in the range above 10% by weight lowers the workability, and particularly is liable to lower the resistances to oxidation and corrosion or bring about embrittlement. Thus, 0.5–5% by weight of tungsten is preferable.

Cobalt is added in a range of 0.1–10% by weight to intensify solid solution, and 1–5% by weight of cobalt is preferable to add.

EXAMPLES

Figure 1:
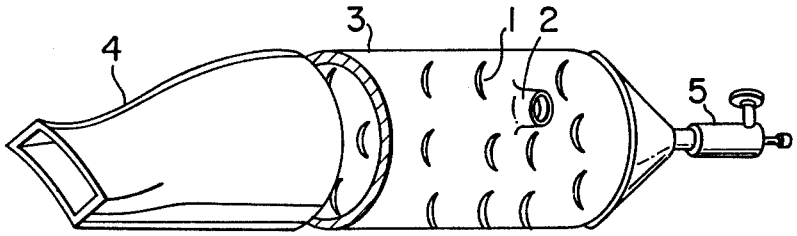
FIG. 1 is a schematical view of gas turbine combustor to which the present invention is applied.

In FIG. 1, a structure of the ordinary gas turbine combuster is shown, where the combustor consists of a liner 3, a transition piece 4 and a fuel nozzle 5. The liner 3 and the transition piece 4 are inserted into each other to prevent leakage of combustion gas. The liner 3 is prepared by bending a steel plate into a cyclindrical shape, welding seamed joints of the steel plate, and providing lower holes 1 and a hole 2 for mounting a cross-fire tube. The transition piece 4 is prepared by bending a steel plate to such a shape as shown in FIG. 1, and welding seamed joints. The steel materials for the liner and the transition piece require good plastic workability, weldability, resistance to oxidation at elevated temperatures, resistance to corrosion at elevated temperatures, resistance to thermal fatigue, resistance to embrittlement and ductility.

Explanation will be made below, referring to the test results:

The following table shows chemical compositions in % by weight of alloys employed in the tests. Among the test pieces, item numbers 1, 2, 5–12 and 14–21 were melted in the atmosphere in a high frequency induction melting furnace and item numbers 3, 4 and 13 were melted in vacuum in the high frequency induction melting furnace, and after forging, they were all heated at 1,100° C. for one hour, and subjected to solid solution treatment by dip cooling in water from that temperature. The alloys of the present invention are item numbers 12–21, and comparative alloys are item numbers 1–11.

Table

| No. | C | Si | Mn | CR | Ni | Mo | W | Co | Ti | Nb | Fe |
|---|---|---|---|---|---|---|---|---|---|---|---|
| 1 | 0.08 | 0.7 | 1.0 | 20.3 | 31.8 | — | — | — | — | — | 46.1 |
| 2 | 0.06 | 1.1 | 1.5 | 26.1 | 46.1 | — | — | — | — | — | 25.1 |
| 3 | 0.09 | 0.2 | 1.1 | 26.1 | 66.7 | — | — | — | — | — | 5.8 |
| 4 | 0.10 | 1.2 | 1.0 | 18.9 | 78.6 | — | — | — | — | — | 0.2 |
| 5 | 0.08 | 1.4 | 1.5 | 28.2 | 45.0 | 3.2 | 4.1 | 3.0 | — | — | 13.6 |
| 6 | 0.09 | 0.6 | 0.7 | 21.6 | 47.8 | 8.4 | 0.8 | 1.6 | — | — | 18.5 |
| 7 | 0.16 | 0.9 | 1.0 | 24.5 | 55.9 | 2.1 | 3.8 | 4.3 | — | — | 7.4 |
| 8 | 0.05 | 0.8 | 1.5 | 25.9 | 47.9 | 2.2 | — | — | 0.2 | — | 21.5 |
| 9 | 0.07 | 1.2 | 1.5 | 28.4 | 46.2 | — | — | — | 0.5 | 0.4 | 21.7 |
| 10 | 0.05 | 0.7 | 1.6 | 26.3 | 48.1 | — | — | — | 0.2 | 0.3 | 22.8 |
| 11 | 0.07 | 0.6 | 1.3 | 19.8 | 40.3 | 3.8 | 2.6 | 2.3 | 0.3 | 0.4 | 28.5 |
| 12 | 0.09 | 1.0 | 1.2 | 25.0 | 49.4 | 7.3 | — | — | 0.3 | — | 15.7 |
| 13 | 0.06 | 1.0 | 1.3 | 17.5 | 65.3 | 5.7 | — | — | — | 0.3 | 8.8 |
| 14 | 0.07 | 0.8 | 0.9 | 25.2 | 45.1 | 5.5 | 5.7 | — | 0.4 | — | 16.3 |
| 15 | 0.09 | 1.3 | 1.1 | 24.6 | 43.5 | 12.3 | — | 2.7 | — | 0.4 | 14.0 |
| 16 | 0.06 | 0.8 | 1.5 | 26.5 | 47.0 | 6.0 | — | — | 0.4 | 0.4 | 17.3 |
| 17 | 0.05 | 0.9 | 1.5 | 27.2 | 44.9 | 6.0 | 0.5 | — | 0.3 | 0.5 | 18.6 |
| 18 | 0.10 | 0.8 | 1.0 | 23.6 | 45.3 | 7.4 | — | 6.9 | 0.4 | 0.3 | 14.2 |
| 19 | 0.08 | 1.0 | 1.3 | 30.7 | 47.2 | 6.3 | 0.8 | 1.4 | 0.5 | — | 10.7 |
| 20 | 0.10 | 0.5 | 0.7 | 22.0 | 46.3 | 9.0 | 0.6 | 1.5 | 0.4 | 0.4 | 18.5 |
| 21 | 0.08 | 0.7 | 0.8 | 22.8 | 44.2 | 8.5 | 0.6 | 1.3 | 0.3 | 0.5 | 20.2 |

Figure 2:
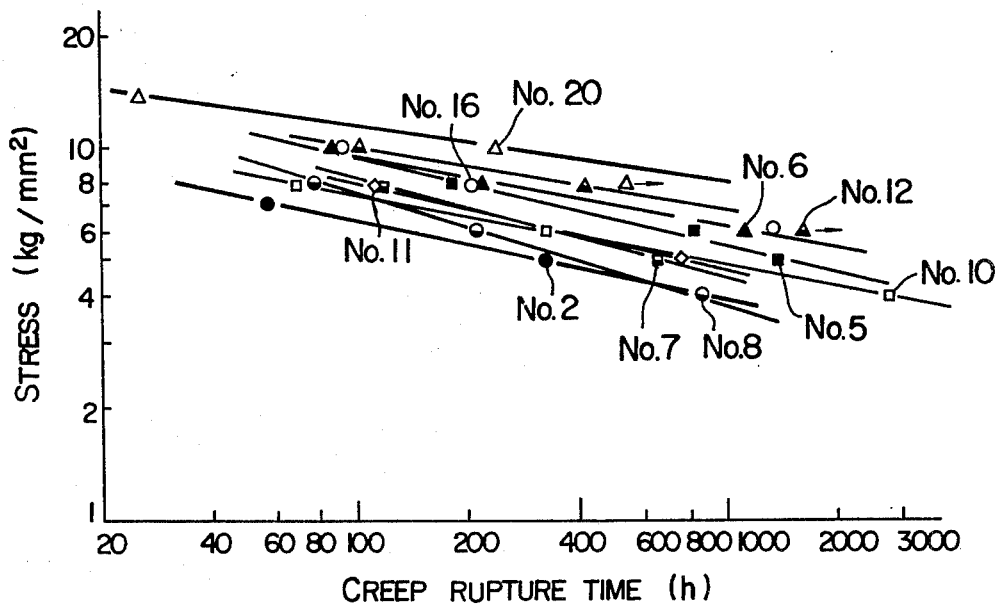
FIG. 2 is a stress-time diagram showing results of creep rupture test at 800° C.

In FIG. 2, a diagram is given to show results of creep rupture tests. The alloys of the present invention, Nos. 12, 16 and 20, containing more than 4.5% by weight of molybdenum, and titanium or both titanium and niobium have a higher creep rupture strength than the comparative alloys Nos. 2, 5, 6, 7, 8, 10 and 11 containing less than 4.5% by weight of molybdenum. Particularly in the alloys of the present invention, the creep rupture strength becomes higher in order of increasing molybdenum content such as from No. 16 through No. 12 to No. 20. Thus, the strength can be improved by increasing the molybdenum content, ensuring the application to materials requiring higher strength as the heat-resisting alloy.

Figure 3:
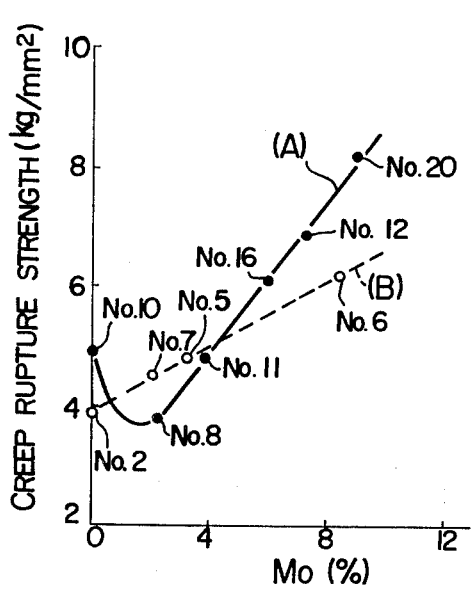
FIG. 3 is a diagram showing relations between creep rupture strength at 800° C. for a duration of 1,000 hours and molybdenum content.

In FIG. 3, a diagram is given to show relations between creep rupture strength at 800° C. for 1,000 hours and molybdenum content, where symbol (A) shows those containing titanium and niobium, and symbol (B) those containing neither titanium nor niobium. In the case of (A), the strength is lowered at the molybdenum content of about 2% by weight, but drastically increased with increasing the molybdenum content over 2% by weight, as shown in FIG. 2, and also in the case of (B), the strength is increased with increasing molybdenum content. Especially, the alloys of the present invention containing molybdenum, and titanium and niobium in combination and having a molybdenum content higher than 4.5% by weight have a considerably higher effect of molybdenum addition than the comparative alloys containing no titanium and molybdenum and having the same molybdenum content.

Figure 4:
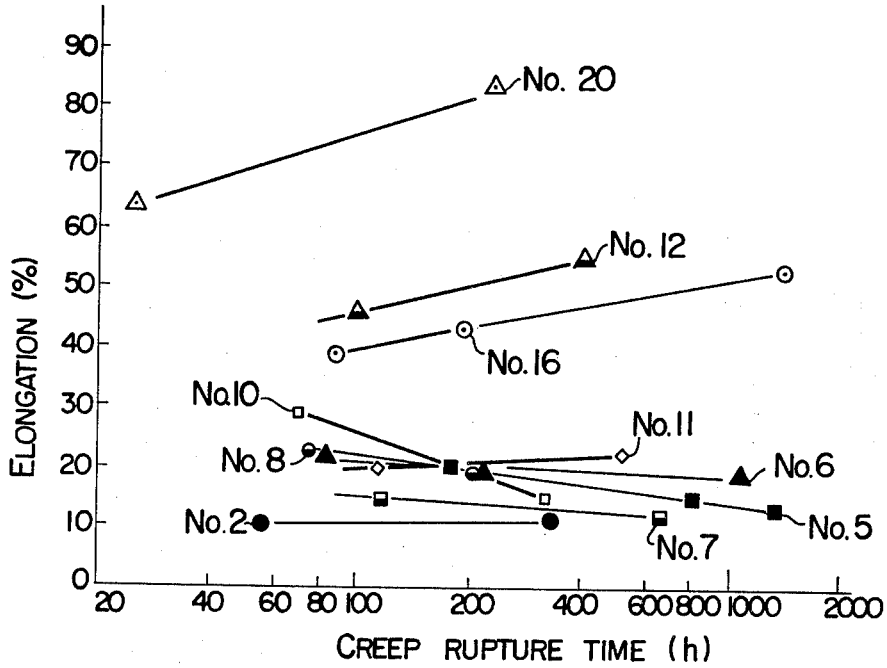
FIG. 4 is a diagram showing percent elongation after creep rupture tests at 800° C.

In FIG. 4, percent elongation after creep rupture tests at 800° C. is given. The alloys of the present invention, Nos. 12, 16 and 20 containing more than 4.5% by weight of molybdenum, and titanium and niobium have a considerably higher percent elongation than the comparative alloys Nos. 2, 5, 6, 7, 8, 10 and 11 containing less than 4.5% by weight of molybdenum. Furthermore, the percent alongation of the comparative alloys is lowered in increasing time, whereas that of any of the alloys of the present invention is increased in increasing time. That is, it is presumed that the alloys of the present invention has a higher resistance to embrittlement by heating for a prolonged period of time.

Figure 5:
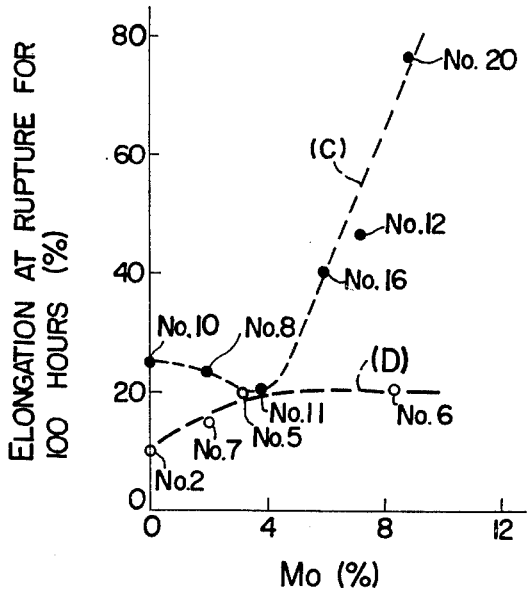
FIG. 5 is a diagram showing relations between percent elongation after creep rupture tests at 800° C. for a duration of 100 hours and molybdenum content.

In FIG. 5, a diagram is given to show relations between percent elongation at rupture for 100 hours after the creep rupture tests at 800° C. in FIG. 4, and molybdenum content. It is seen from FIG. 5 that in the alloys containing titanium and niobium (C), the percent elongation is drastically increased if the molybdenum content exceeds 4% by weight, and the effect of combined addition of molybdenum, and titanium and niobium is observable, whereas in the alloys containing no titanium and niobium (D), no large increase in percent elongation is observable with increasing molybdenum content. When comparison is made of the alloys of the present invention at the same molybdenum content, the alloy No. 12 containing titanium alone passes through a lower point than the corresponding point on the line plotted between the alloys Nos. 16 and 20 containing both titanium and niobium in combination, and thus the alloys containing both titanium and niobium in combination can have an especially high ductility.

Percent reduction of area of the alloys of the present invention after the creep rupture is more than 40%, whereas that of the comparative alloys is less than 30%.

As described above, the alloys of the present invention have high creep rupture strength and creep rupture ductility, and are satisfactory as a high temperature-resisting material.

To investigate characteristics necessary for application to gas turbine combuster liner and transition piece, hot corrosion and thermal fatigue tests were carried out.

Figure 6:
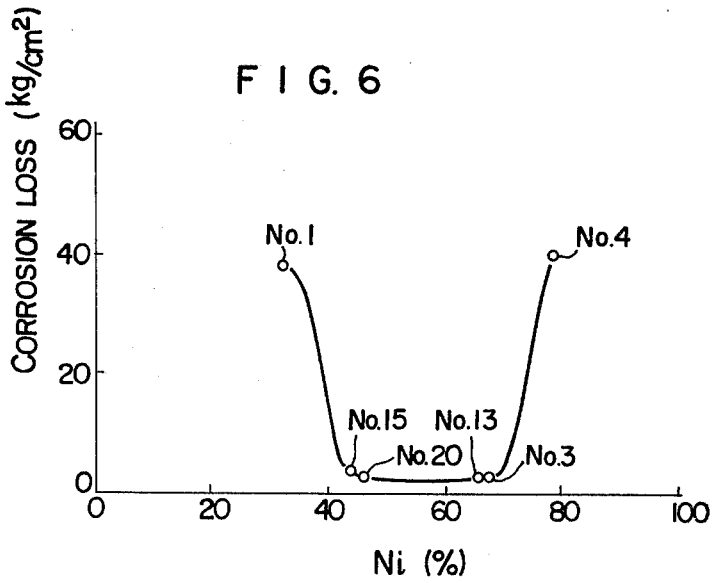
FIG. 6 is a diagram showing relations between corrosion loss and nickel content in hot corrosion tests.

In FIG. 6, a diagram is given to show relations between corrosion loss of test pieces and nickel content of the alloys when surfaces of the test pieces (5 mm thick × 8 mm wide × 50 mm long) were coated with a salt mixture consisting of 25% by weight of sodium chloride and 75% by weight of sodium sulphate at a rate of 10 mg/cm$^2$ through heating and melting, and the coated test pieces were heated in the atmosphere for 50 hours as hot corrosion test. It is seen from FIG. 6 that the alloys of the present invention containing 43–70% by weight of nickel have the lowest corrosion loss, but the corrosion loss drastically increases at the nickel content outside said range, that is, less than 43% by weight or more than 70% by weight.

Generally, hot corrosion develops on materials exposed to combustion gas of light oil, kerosene, etc., for example, combustor liner and transition piece for gas turbine, and thus the alloys of the present invention have a good resistance to hot corrosion, and can provide materials satisfactory for the liner and transition piece.

Figure 7:
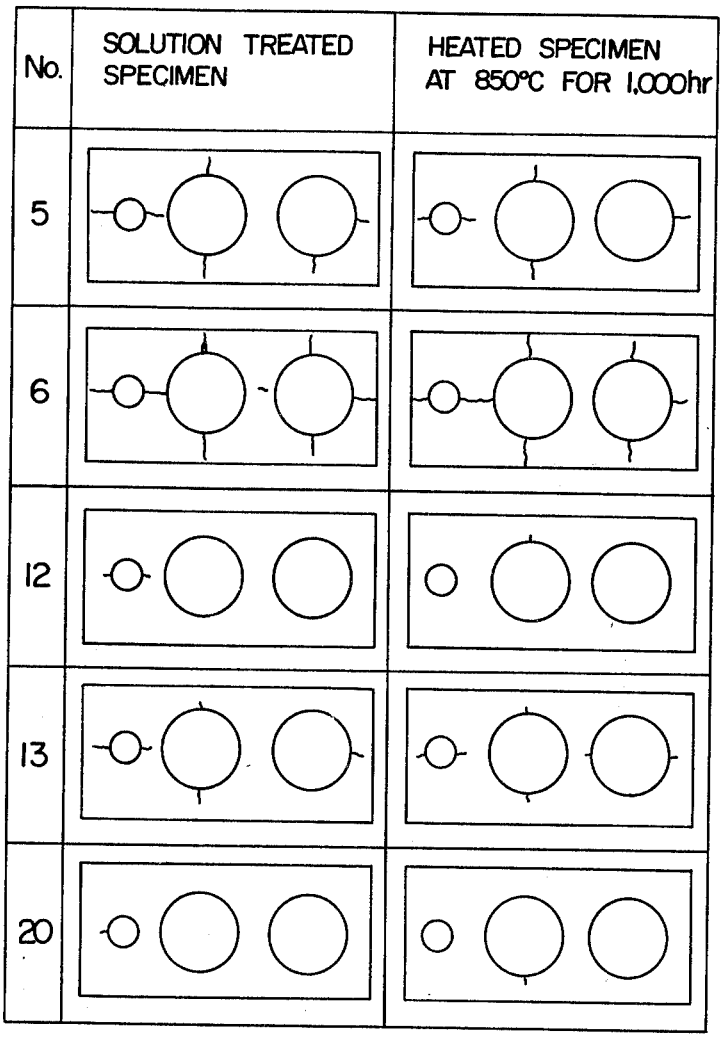
FIG. 7 shows cross-sectional shapes of test pieces indicating results of thermal cycle fatigue tests.

In FIG. 7, results of thermal fatigue tests are shown. Thermal fatigue test was carried out by providing a water bath under a vertical electric furnace, and putting a test piece into the water bath and the electric furnace heated to 800° C., alternately, where a step of retaining the test piece in the electric furnace for 6 minutes, and then placing and retaining the test piece in the water bath for 6 seconds was made as one cycle, the test piece was subjected to the predetermined number of the cycles, then the test piece was taken out and cut to two portions, and cracking state of cross-section was observed. The test piece was 5 mm thick×9 mm wide and 20 mm long, and had a hole, 2 mm in diameter, and two holes, each 5 mm in diameter. In FIG. 7, the left column relates to the alloys resulting directly from solid solution treatment as such, and the right column relates to the alloys heated at 850° C. for 1,000 hours to effect enbrittlement after the solid solution treatment. It is seen from FIG. 7 that the alloys of the present invention Nos. 12, 13 and 20 are less in cracking and deformation of test pieces than the comparative alloys Nos. 5 and 6. That is, the alloys of the present invention have a good resistance to thermal shock by rapid heating and quenching, and also have a good resistance to the heating enbrittlement.

The combustor liner and transition piece for the gas turbine are subject to repetitions of rapid heating by hot combustion gas at the start of operation and rapid cooling by the stopping of operation, that is, undergo thermal fatigue, but it is seen that the alloys of the present invention have the characteristics satisfactory for these materials.

The alloy of the present invention No. 21 was hot rolled to prepare a plate, and a liner and transition piece were prepared from the resulting plate by bending and arc welding without any filler metal in the case of liner and arc welding with a filler metal in the case of transition piece. The filler metal was prepared by forging the alloy of the present invention No. 21 and then drawing the forged alloy to a wire, 1.6 mm in diameter. The welded liner and transition piece had no welding defects and good welding beads.

Hot rolling of the alloys of the present invention could be carried out very easily, after hot forging, without any occurrence of defects due to the rolling. That is, the alloys of the present invention provide satisfactory plastic working materials, and also have a good weldability as filler metal, as described above, and thus provide a satisfactory filler metal.

Said liner was assembled into an actual gas turbine and used for 10,000 hours, and only very small cracking was observed at lower holes. The portions on which fine cracks were partly observed could be repaired by TIG welding without any filler metal, without any trouble.

What is claimed is:

1. An alloy of iron-nickel-chromium-molybdenum system having a high ductility, which consists essentially of 0.03–0.2% by weight of carbon, 0.5–1.5% by weight of silicon, 0.5–2% by weight of manganese, 42–70% by weight of nickel, 15–35% by weight of chromium, 4.5–15% by weight of molybdenum, 0.05–1% by weight of at least one of titanium and niobium as an additive element, and 7.5–35% by weight of iron, the balance being incidental impurities.

2. An alloy according to claim 1, wherein the additive element is titanium.

3. An alloy according to claim 1, wherein the additive element is niobium.

4. An alloy according to claim 1, wherein the additive element is 0.05–1.0% by weight in total of titanium and niobium.

5. An alloy of iron-nickel-chromium-molybdenum system having a high ductility, which consists essentially of 0.05–0.15% by weight of carbon, 0.5–1.5% by weight of silicon, 0.5–2% by weight of manganese, 44–50% by weight of nickel, 22–30% by weight of chromium, 5–10% by weight of molybdenum, 0.2–0.6% by weight of at least one of titanium and niobium as an additive element, and 15–25% by weight of iron, the balance being incidental impurities.

6. An alloy according to claim 5, wherein the additive element is titanium.

7. An alloy according to claim 5, wherein the additive element is niobium.

8. An alloy according to claim 5, wherein the additive element is 0.2–0.6% by weight in total of titanium and niobium.

9. An alloy of iron-nickel-chromium-molybdenum system having a high ductility, which consists essentially of about 0.06% by weight of carbon, about 0.8% by weight of silicon, about 1.5% by weight of manganese, about 47% by weight of nickel, about 26.5% by weight of chromium, about 6% by weight of molybdenum, about 0.4% by weight of titanium, about 0.4% by weight of niobium, the balance being iron and incidental impurities.

10. An alloy of iron-nickel-chromium-molybdenum system having a high ductility, which consists essentially of 0.03–0.2% by weight of carbon, 0.5–1.5% by weight of silicon, 0.5–2% by weight of manganese, 42–70% by weight of nickel, 15–35% by weight of chromium, 4.5–12% by weight of molybdenum, 0.05–1% by weight of at least one of titanium and niobium as an additive element, 0.1–10% by weight of at least one of tungsten and cobalt as an intensifying element, and 7.5–35% by weight of iron, the balance being incidental impurities.

11. An alloy of iron-nickel-chromium-molybdenum system having a high ductility, which consists essentially of 0.05–0.15% by weight of carbon, 0.5–1.5% by weight of silicon, 0.5–2% by weight of manganese, 44–50% by weight of nickel, 22–30% by weight of chromium, 5–10% by weight of molybdenum, 0.2–0.6% by weight of at least one of titanium and niobium as an additive element, 0.3–5% by weight of at least one of tungsten and cobalt as an intensifying element, and 15–25% by weight of iron, the balance being incidental impurities.

12. An alloy according to claim 11, wherein the additive element is titanium and niobium, and the intensifying element is tungsten.

13. An alloy according to claim 11, wherein the additive element is titanium and niobium, and the intensifying element is cobalt.

14. An alloy according to claim 11, wherein the additive element is titanium, and the intensifying element is tungsten and cobalt.

15. An alloy according to claim 11, wherein the additive element is titanium and niobium, and the intensifying element is tungsten and cobalt.

16. An alloy of iron-nickel-chromium-molybdenum system having a high ductility, which consists essentially of about 0.1% by weight of carbon, about 0.5% by weight of silicon, about 0.7% by weight of manganese, about 46% by weight of nickel, about 22% by weight of chromium, about 9% by weight of molybdenum, about 0.6% by weight of tungsten, about 1.5% by weight of cobalt, about 0.4% by weight of titanium, and about 0.4% by weight of niobium, the balance being iron and incidental impurities.

17. An alloy of iron-nickel-chromium-molybdenum system having a high ductility, which consists essentially of 0.03–0.2% by weight of carbon, 0.5–1.5% by weight of silicon, 0.5–2% by weight of manganese, 42–70% by weight of nickel, 15–35% by weight of chromium, 4.5–15% by weight of molybdenum, 0.05–1% by weight of at least one of titanium and niobium as an additive element, and 7.5–35% by weight of iron, the balance being incidental impurities, and the alloy being processed by at least one of rolling and forging.

18. A combustor for a gas turbine comprising a fuel nozzle for injecting fuel, a liner for combusting the injected fuel, and a transition piece having a throttled open end at nozzle side for supplying combustion gas to a turbine nozzle, at least one of the liner and the transition piece being made of an alloy consisting essentially of 0.03–0.2% by weight of carbon, 0.5–1.5% by weight of silicon, 0.5–2% by weight of manganese, 42–70% by weight of nickel, 15–35% by weight of chromium 4.5–12% by weight of molybdenum, 0.05–1.0% by weight of at least one of titanium and niobium as an additive element, and 7.5–35% by weight of iron, the balance being incidental impurities.

19. A combustor according to claim 18, wherein the additive element is titanium.

20. A combustor according to claim 18, wherein the additive element is niobium.

21. A combustor according to claim 18, wherein the additive element is 0.05–1.0% by weight of both titanium and niobium.

22. A combustor for a gas turbine comprising a fuel nozzle for injecting fuel, a liner for combusting the injected fuel, and a transition piece having a throttled open end at nozzle side for supplying combustion gas to a turbine nozzle, at least one of the liner and the transition piece being made of an alloy consisting essentially of 0.05–0.15% by weight of carbon, 0.5–1.5% by weight of silicon, 0.5–2% by weight of manganese, 44–50% by weight of nickel, 22–30% by weight of chromium, 5–10% by weight of molybdenum, 0.2–0.6% by weight of at least one of titanium and niobium as an additive element, and 15–25% by weight of iron, the balance being incidental impurities.

23. A combustor according to claim 22, wherein the additive element is titanium.

24. A combustor according to claim 22, wherein the additive element is niobium.

25. A combustor according to claim 22, wherein the additive is 0.2–0.6% by weight of both titanium and niobium.

26. A combustor for a gas turbine comprising a fuel nozzle for injecting fuel, a liner for combusting the injected fuel, and a transition piece having a throttled open end at nozzle side for supplying combustion gas to a turbine nozzle, at least one of the liner and the transition piece being made of an alloy consisting essentially of 0.05–0.15% by weight of carbon, 0.5–1.5% by weight of silicon, 0.5–2% by weight of manganese, 44–50% by weight of nickel, 22–30% by weight of chromium, 5–10% by weight of molybdenum, 0.2–0.6% by weight of at least one of titanium and niobium as an additive element, 0.3–5% by weight of at least one of tungsten and cobalt as an intensifying element, and 15–25% by weight of iron, the balance being incidental impurities.

27. A combustor according to claim 26, wherein the intensifying element is tungsten.

28. A combustor according to claim 26, wherein the intensifying element is cobalt.

29. A combustor according to claim 26, wherein the intensifying element is tungsten and cobalt.

30. A combustor for a gas turbine comprising a fuel nozzle for injecting fuel, a liner for combusting the injected fuel, and a transition piece having a throttled open end at nozzle side for supplying combustion gas to a turbine nozzle, at least one of the liner and the transition piece being made of an alloy consisting essentially of about 0.06% by weight of carbon, about 0.8% by weight of silicon, about 1.5% by weight of manganese, about 47% by weight of nickel, about 27% by weight of chromium, about 6% by weight of molybdenum, about 0.4% by weight of titanium, and about 0.4% by weight of niobium, the balance being iron and incidental impurities.

31. A combustor for a gas turbine comprising a fuel nozzle for injecting fuel, a liner for combusting the injected fuel, and a transition piece having a throttled open end at nozzle side for supplying combustion gas to a turbine nozzle, at least one of the liner and the transition piece being made of an alloy consisting essentially of about 0.1% by weight of carbon, about 0.5% by weight of silicon, about 0.7% by weight of manganese, about 46% by weight of nickel, about 22% by weight of chromium, about 9% by weight of molybdenum, about 0.6% by weight of tungsten, about 1.5% by weight of cobalt, about 0.4% by weight of titanium, and about 0.4% by weight of niobium, the balance being iron and incidental impurities.

32. A filler metal, which consists essentially of 0.03–0.2% by weight of carbon, 0.5–1.5% by weight of silicon, 0.5–2% by weight of manganese, 42–70% by weight of nickel, 15–35% by weight of chromium, 4.5–15% by weight of molybdenum, 0.05–1% by weight of at least one of titanium and niobium as an additive element, and 7.5–35% by weight of iron, the balance being incidental impurities.

33. A filler metal, which consists essentially of 0.05–0.15% by weight of carbon, 0.5–1.5% by weight of silicon, 0.5–2% by weight of manganese, 44–50% by weight of nickel, 22–30% by weight of chromium, 5–10% by weight of molybdenum, 0.2–0.6% by weight of at least one of titanium and niobium as an additive element, and 15–25% by weight of iron, the balance being incidental impurities.

34. A filler metal, which consists essentially of 0.05–0.15% by weight of carbon 0.5–1.5% by weight of silicon, 0.5–2% by weight of manganese, 44–50% by weight of nickel, 22–30% by weight of chromium, 5–10% by weight of molybdenum, 0.2–0.6% by weight of at least one of titanium and niobium as an additive element, 0.3–5% by weight of at least one of tungsten and cobalt as an intensifying element, and 15–25% by weight of iron, the balance being incidental impurities.

* * * * *